United States Patent [19]

Miyai et al.

[11] Patent Number: 4,789,876

[45] **Date of Patent: * Dec. 6, 1988**

[54] PORTABLE TYPE IMAGE FORMING APPARATUS

[75] Inventors: Kiyoshi Miyai; Shuhei Uotani, both of Himeji; Toyohiko Tsunemine, Hyogo, all of Japan

[73] Assignee: Sanyo Electric Co., Ltd., Japan

[ * ] Notice: The portion of the term of this patent subsequent to Sep. 2, 2003 has been disclaimed.

[21] Appl. No.: 906,453

[22] Filed: Sep. 11, 1986

[30] Foreign Application Priority Data

| | | | |
|---|---|---|---|
| Oct. 11, 1985 | [JP] | Japan | 60-155823[U] |
| Oct. 14, 1985 | [JP] | Japan | 60-229323 |
| Oct. 14, 1985 | [JP] | Japan | 60-229324 |
| Oct. 18, 1985 | [JP] | Japan | 60-160128[U] |
| Oct. 18, 1985 | [JP] | Japan | 60-160129[U] |
| Oct. 23, 1985 | [JP] | Japan | 60-162251[U] |

[51] Int. Cl.[4] ..... G03G 21/00

[52] U.S. Cl. ..... 355/3 R; 355/21

[58] Field of Search ..... 355/3 R, 3 SH, 14 R, 355/21

[56] References Cited

U.S. PATENT DOCUMENTS

| | | | |
|---|---|---|---|
| 4,128,334 | 12/1978 | Yanagawa et al. | 355/8 X |
| 4,416,536 | 11/1983 | Itoh et al. | 355/14 R |
| 4,465,359 | 8/1984 | Nakahata | 355/3 R |
| 4,542,976 | 9/1985 | Kasamura | 355/3 R |
| 4,583,832 | 4/1986 | Kasamura et al. | 355/3 R X |
| 4,609,281 | 9/1986 | Miyai et al. | 355/3 R |
| 4,705,384 | 11/1987 | Mizutani et al. | 355/3 R |

*Primary Examiner*—Fred L. Braun

*Attorney, Agent, or Firm*—Darby & Darby

[57] ABSTRACT

A portable type image forming apparatus has a body with an upper and lower body members which are coupled by a hinge. A locking mechanism for locking the upper and lower members is provided at one side face of said upper body and lower body. At least one handle is provided for transporting the apparatus at the side face of the body opposite to the side face receiving the hinge. An auxiliary locking mechanism for locking the upper and lower members when the handle is held during transport is also provided.

11 Claims, 8 Drawing Sheets

PORTABLE TYPE IMAGE FORMING APPARATUS

BACKGROUND OF THE INVENTION

1. Field of the Invention

The present invention relates to an image forming apparatus for an electronic copying machine, a printer, a facsimile equipment and the like, and more particularly to an image forming apparatus of a portable type provided with handles for transportation.

2. Description of the Prior Art

The image forming apparatus such as the electronic copying machine, printer and facsimile equipment, has hitherto been promoted to be compact and lightweight as a whole with the miniaturization of the circuit element. The conventional electronic copying machine has usually been very heavy and of large-size, thereby having been provided at four corners with handles horizontally projectable and retractable with respect to the main body of the copying machine respectively. The main body, when transported, is raised with the handles drawn out, gripped and raised by two operators. As a result, two operators are indispensable for transporting the image forming apparatus.

But, recently, a small-sized and lightweight image forming apparatus, especially an electronic copying machine, has been developed to be transportable by only one operator. Such image forming apparatus, however, must be raised by an operator using both hands holding the bottom of the body at both sides thereof, thereby being not easy to transport.

An example of the image forming apparatus is disclosed in the U.S. Pat. No. 4,465,359, which is provided at the side walls of the copying machine with the handles. Such consideration, however, does not refer to the copying machine being dividable into upper body and lower body into two. The image forming apparatus, such as copying machine having the construction of dividable into upper body and lower body into two can be small-sized because these is no need of providing in the body a jam disposal space (through which the operator inserts his hand into the apparatus for the jam disposal), thereby being easily transportable with a handle provided at one side. But the problems here are the safe transportation and the safe locking mechanism of the apparatus of being such a construction dividable into two when in long use. Concretely, in a case where the handle is provided at one side face of the image forming apparatus dividable into two, the locking mechanism, when the body is raised for transportation and during the transportation, is subjected to a load to create a backlash, and especially, the upper and lower halves of the body shift or twist each other, thereby creating the problem in that the image stable in quality is impossible to be formed.

Also, the locking mechanism is required not to be disengaged during the transportation, and should ensure the safe transportation even if disengaged.

SUMMARY OF THE INVENTION

In the light of the above problems, the present invention has been designed. A main object thereof is to provide such an image forming apparatus whose body is divided into two as having a construction of being ensured the safety during the transportation and the stability of a locking mechanism in the apparatus.

The image forming apparatus of the present invention is provided with a hinge through which the body is divided into two, upper and lower bodies, at the face opposite to the face having hinge with a locking mechanism for locking the upper and lower bodies, and at the same face having the hinge, or at the opposite face thereto, with a handle(s) through which the apparatus is transported, thereby ensuring the safety during the transportation and the stability of the locking mechanism which is prevented from being subjected to a twisting force.

The above and further objects and features of the invention will more fully be apparent from the following detailed description with accompanying drawings.

DESCRIPTION OF THE PREFERRED EMBODIMENTS

Next, the present invention will be detailed in accordance with the accompanying drawings.

Figure 1:
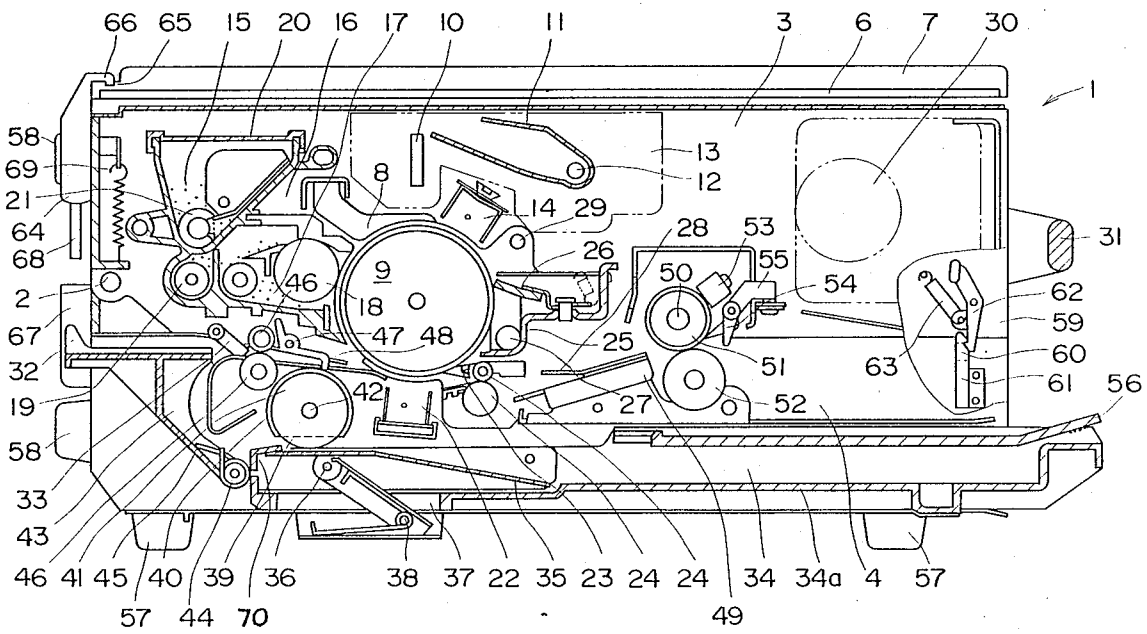
FIG. 1 is a sectional side view of a first embodiment of a copying machine as an image forming apparatus of the present invention.

FIG. 1 is a sectional side view showing construction of a first embodiment of an electronic copying machine as an image forming apparatus, in which reference numeral 1 designates a body of the copying machine, which comprises an upper body 3 and a lower body 4, the upper body 3 being able to be turned upwardly around a hinge pin 2 as the fulcrum, so that a transfer paper, when jammed, can be taken out by opening a transfer paper passage 5.

Firstly, explanation will be given on construction of the upper body 3. On the upper surface thereof, an original receiving plate 6 of transparent glass is disposed to be slidable horizontally, i.e., laterally in FIG. 1, and an original receiving plate cover 7 which holds the original is mounted on the original receiving plate 6 so as to be opened and closed freely. Reference numeral 8 designates a drum unit detachably mounted on the upper body 3, in which a photosensitive drum 9 and a cleaning unit to be discussed below are unitized. Above the photosensitive drum 9 is vertically provided with a short focus length lens train 10 for forming on the peripheral surface of photosensitive drum 9 the image of an original placed on the original receiving plate 6. An exposure lamp (halogen lamp) 12 provided with a reflecting mirror 11 elliptic in section for radiating the light on the original surface is provided rightwardly of the short focus length lens train 10, the short focus length lens train 10 and exposure lamp 12 being fixed to the same chassis 13.

At the upstream side of the short focus length lens train 10 is disposed an electrifying corotron 14 for uniformly positively electrifying the photosensitive drum 9.

At the downstream side of the short focus length lens train 10 in the rotating direction of the photosensitive drum 9 is provided with a developing unit 16 for developing with toner 15 the electrostatic latent images formed on the photosensitive drum 9, the developing unit 16 containing therein in relation of being rotatable a magnet roller for conveying a developer 17 comprising a mixture of toner with carrier toward the surface of the photosensitive drum 9 and a screw 19 for mixing the toner and carrier. Reference numeral 20 designates a toner hopper fixed integrally on the upper portion of the developing unit 16. The toner hopper 20 is provided at the bottom with a screw roller 21 for supplying little by little to the developing unit 16 the toner contained in the hopper 20. In addition, the developing unit 16 and toner hopper 20, in the same way as the aforesaid drum unit 8, are detachably mounted on the upper body 3.

Reference numeral 22 designates a transfer corotron which is mounted on the lower body 4 at the downstream side of the developing unit 16 in the rotating direction of the photosensitive drum 9 and transfers to a transfer paper the toner on the photosensitive drum 9 developed by the developing unit 16. At the downstream side of the transfer corotron in the rotating direction of the photosensitive drum 9 and at the upper body 3 side is disposed a peel-off pawl 23 for peeling off the transfer paper from the photosensitive drum 9. The peel-off pawl 23 is provided onto a support shaft of an upper roller 24 of a pair of rollers 24 and biased at the tip rotatably toward the surface of the photosensitive drum 9.

At the downstream side of the peel-off pawl 23 in the rotating direction of the photosensitive drum 9 is provided with a cleaning device 25 for removing from the photosensitive drum 9 the remaining toner which have not been transferred onto the transfer paper from drum 9. The cleaning device 25 houses therein a blade 26 of urethane rubber for scraping-off the remaining toner from the photosensitive drum 9 and a screw conveyor 27 for discharging the toner scraped-off by the blade 26. In addition, the cleaning unit 25, peel-off pawl 23 and rollers 24 are integral with the photosensitive drum 9 on the same chassis 28. An erase lamp 29 for erasing the entire residual charge on the photosensitive drum 9 is provided at the downstream side of the cleaning unit 25 in the rotating direction of the photosensitive drum 9. Reference numeral 30 designates a motor for driving the photosensitive drum 9 and original receiving plate 6, and 31 designates an inverted-U-like-shaped handle provided at the upper body 3 and at the side surface thereof opposite to the hinge 2, the handle 31 being utilized for opening the upper and lower bodies 3 and 4 other than used for transportation.

Next, explanation will be given on construction of the lower body 4.

In FIG. 1, reference numeral 32 designates a manipulative paper feeder table, and at the downstream side thereof in the paper feeding direction is provided with a start switch 33 serving also as a jam sensor.

Reference numeral 34 designates a paper feeding cassette, easily disconnectable, mounted horizontally on the inner bottom of the lower body 4, and disposed leftwardly from the right-hand end of the copying machine body 1. A support plate 35 loading thereon a transfer paper (not shown) is swingably provided at the inner bottom of the support plate 34*a* of the paper feeding cassette 34, and below the support plate 35 is provided with an opening 37 through which a free end of a push-up lever 36 at the base thereof swingably on a swollen portion at the bottom of the lower body 4 is passable. A torsion spring 38 for clockwise rotatably biasing the push-up lever 36 is thereon, so that the support plate 35 is biased upwardly by the torsion spring 38.

Above the downstream side end of the paper feeding cassette 34 is provided with a paper feeding roller 40, so-called the segment roller, formed of a high friction material, such as rubber, and partially, a cut out 39 for feeding the transfer papers one by one. Reference numeral 41 designates an idler formed of a low friction material, such as plastic, for preventing the cutout 39 of the paper feed roller 40 from contacting with the transfer paper when the cutout 39 is opposite thereto, the idler 41 being rotatably inserted onto a support shaft 42 for the paper feeding roller 40, and 43 designates a corner separator which separates the transfer papers one by one. At the downstream side of the paper feeding cassette 34 is provided with a guide 43 for upwardly turning the transfer paper sent by the paper feeding roller 40. The guide 43 is integral with the paper feeding table 32 and is rotatable counterclockwise around a support shaft 44 as a fulcrum, inserted into the lower end of the paper feeding plate 32. Also, reference numeral 45 designates a torsion spring for biasing the guide 43 clockwise rotatably.

At the downstream side of the guide 43 in the paper feeding direction are provided with a pair of register rollers 46 for feeding, in synchronism with operation of the original receiving plate 6, the transfer paper being fed from the paper feeding cassette 34 or the paper feeding plate 32. The lower one of the register rollers 46 is connected with a drive source and continuously rotatable. The register rollers 46 are in press-contact relatively lightly with each other, so that the transfer paper, when not regulated by other means, is to be fed, but, when regulated by other means, is to slip with respect to the rollers 46.

At the downstream side of the pair of register rollers 46 in the paper feeding direction is provided with a stopper 48 mounted rotatably on a support shaft 47, the stopper 48 is L-like-shaped at its free end and the tip thereof is adapted to be able to project or retract with respect to a paper feed passage 5. Accordingly, the transfer paper coming when the stopper 48 enters at utmost end thereof into the paper feed passage, is to be prevented at its downstream side end in the paper feeding direction from its forward movement by the utmost end of the stopper 48, thereby putting the transfer paper in slipping condition with respect to the pair of register rollers 46. Upon retracting of the utmost end of the stopper 48 from the paper-feed passage at a proper timing, the transfer paper temporarily having been stopped by the stopper 48 is to be refed by the pair of register rollers 46. In addition, reference numeral 49 designates a paper feeding guide provided at the downstream side of the pair of conveying rollers 24 in the paper feeding direction.

At the downstream side of the paper feed guide 49 in the paper feeding direction is provided with a fixing unit comprising a heating roller 51 into which a halogen lamp 50 of about 800 W is inserted a pressure roller 52 in press-contact with the heating roller 51. In addition, reference numeral 53 designates a temperature sensor for the heating roller 51, 54 designates a peel-off pawl, and 55 designates a jam sensor. Then, the transfer paper on which the toner images are fixed is to be discharged onto a paper discharge tray 56 serving also as the cover for the paper feed cassette 34. In addition, the paper discharge tray 56 is adapted to be movable in parallel (laterally) to the inner bottom of a box 34*a* at the paper feed cassette 34, so that, when the paper feed cassette 34 is taken out of the copying machine body 1, the paper discharge tray 56 serves as the cover.

Also, reference numerals 57 designate cushion members for supporting in normal the body 1, and 58 designates cushion members formed on the side surfaces of the upper and lower bodies 3 and 4 opposite to the handle 31 and used when in transportation.

Reference numeral 59 designates a locking mechanism provided at the side walls of the upper and lower bodies 3 and 4 opposite to the hinge pin 2, the locking mechanism 59 comprising a fixture 61 having a bore 60, formed at the lower body 4 and a hook 62 mounted rotatably on the upper body 3 and engageable with the bore 60, and 63 designates a spring for biasing the hook 62 counterclockwise.

Figure 5:
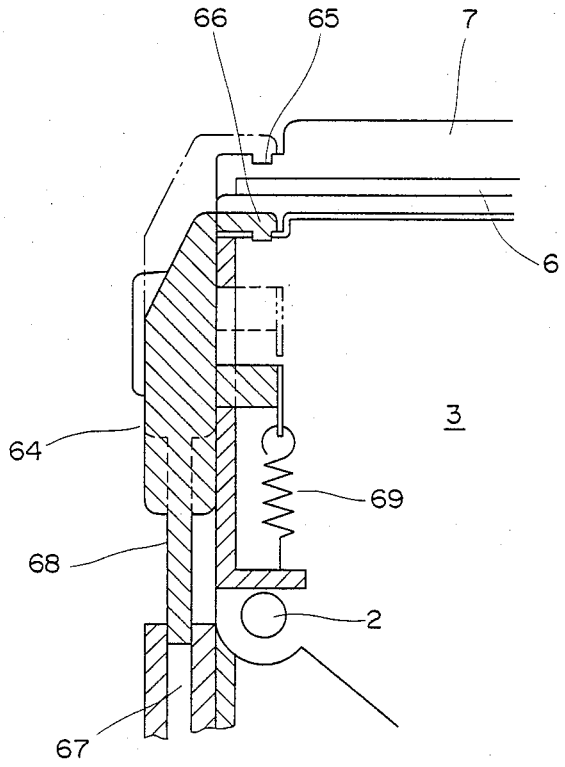
FIG. 5 is a partially enlarged sectional side view of the body, in which the original receiving plate locking mechanism is shown.

Reference numeral 64 designates an original receiving plate locking mechanism, as enlarged in FIG. 5, for preventing the original receiving plate 6 from moving when the body 1 is divided into two. the locking mechanism 64 is mounted vertically movably on the side surface of the upper body 3, and has at one end a projection 66 engageable with a recess 65 provided at the original receiving plate cover 7 and at the other end a pin 68 entering into a bore 67 provided at the side surface of the lower body 4 opposite to the upper body 3 when the original receiving plate 6 is not locked, so that, even when the locking mechanism 59 for the upper and lower bodies 3 and 4 is released during the engagement of the pin 68 with the bore 67, the upper and lower bodies 3 and 4 cannot be opened. In addition, 69 designates a spring for downwardly biasing the original receiving plate locking mechanism 64.

Next, explanation will be given on operation of the image forming apparatus of the invention.

Figure 4:
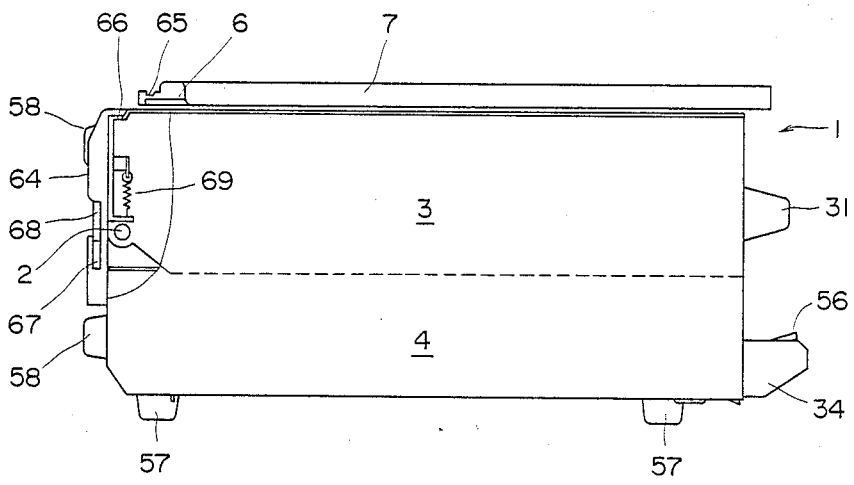

For the usual copying, as shown in FIG. 4, the original receiving plate locking mechanism 64 is once raised to disengage the projection 66 thereof from the recess 65 at the original receiving plate cover 7, thereby unlocking the original receiving plate 6 by moving the original receiving plate cover 7 rightwardly in the drawing. After an original is placed on the original receiving plate 6, a copy start switch (not shown) is turned on so as to move the original receiving plate 6 once rightwardly in each drawing and then return it leftwardly. The images of the original are projected to and formed on the photosensitive drum 9 while the plate 6 is returning, thereby forming on the photosensitive drum 9 electrostatic latent images corresponding to the original images, the electrostatic latent images being toner-developed by the developing unit 16, the toner images being transferred by the transfer corotron 22 onto a transfer paper fed from the paper feed cassette 34. The transfer paper onto which the toner images thus are transferred is peeled off from the photosensitive drum 9 by the peel-off pawl 23, and heated and pressurized to be fixed by the fixing device and thereafter discharged onto the paper discharge tray 56.

In addition, the residual charge and residual toner which has not been transferred onto the transfer paper but remains on the photosensitive drum 9, are removed therefrom by the cleaning device 25 and erase lamp 29.

Next, explanation will be given on the disposal when the transfer paper is jammed.

Figure 2:
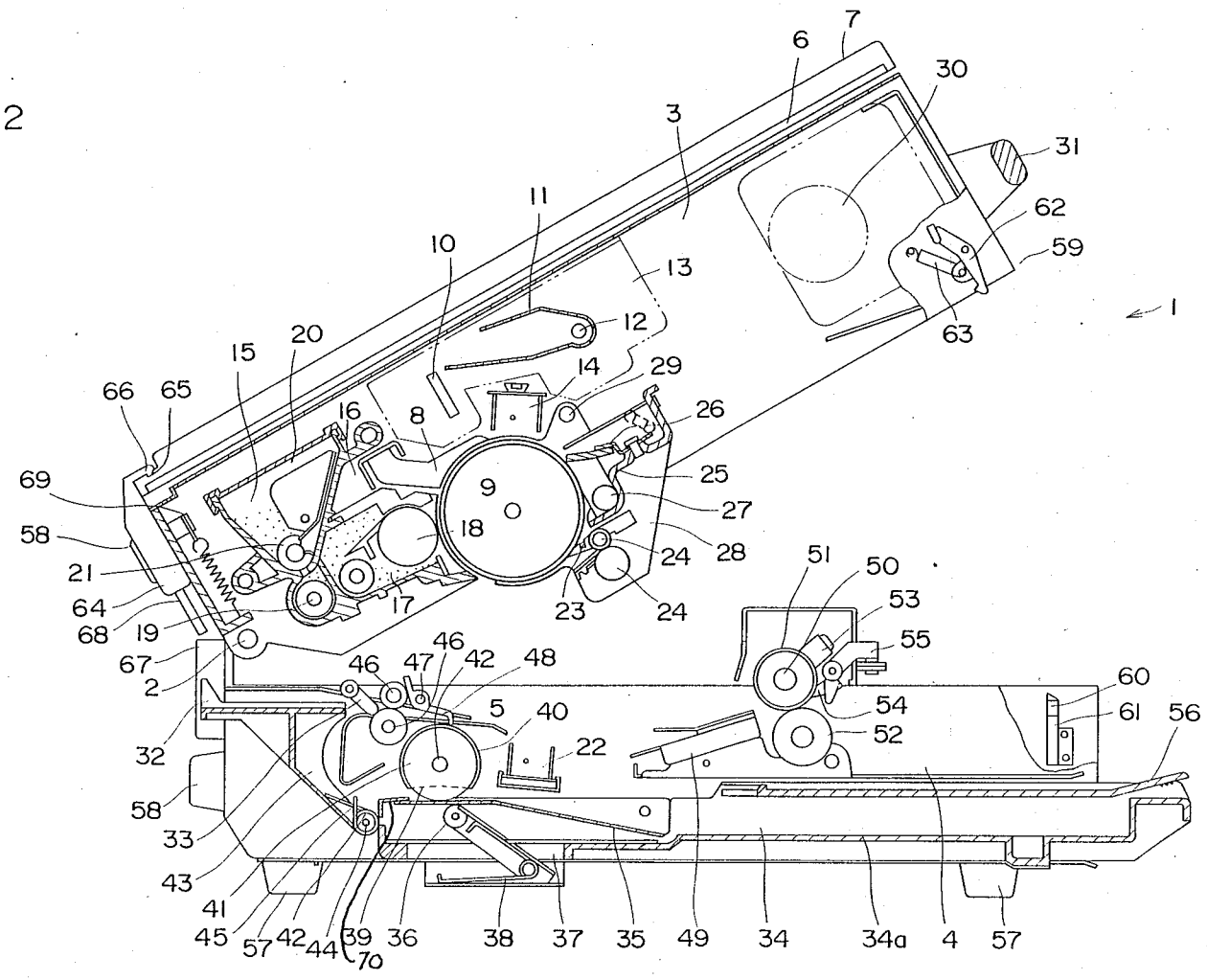
FIG. 2 is a sectional side view of the embodiment shown in FIG. 1, in which an upper body thereof is upwardly open.
Figure 3:
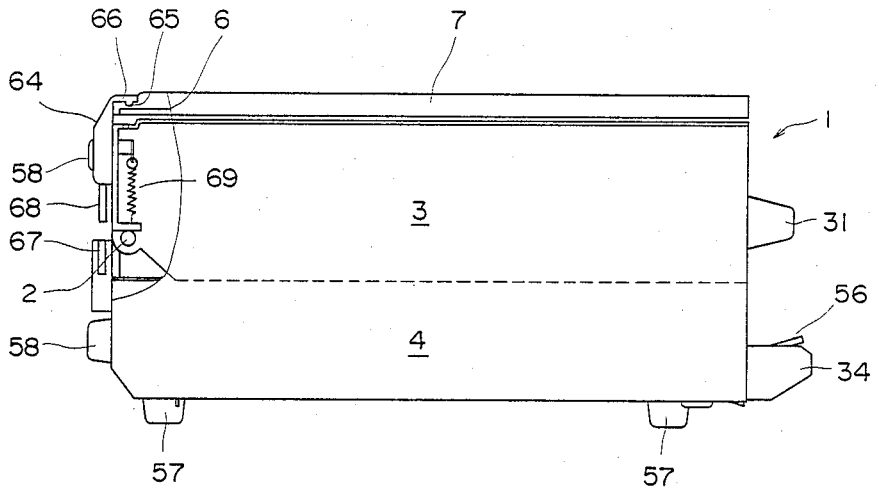
FIGS. 3 and 4 are side views exemplary of an original receiving plate locking mechanism.

At first, as shown in FIG. 3, the original receiving plate locking mechanism 64 is raised, the original receiving plate cover 7 is moved leftwardly in the drawing, and thereafter the projection 66 at the locking mechanism 64 is engaged with the recess 65 at the cover 7, thereby locking the original receiving plate 6. Next, the locking mechanism 59 of the main body 1 is released by disengaging the tip of the hook 62 from the bore 60 at the fixture 61. Then, the upper body 3, as shown in FIG. 2, is turned around the hinge pin 2 by raising the handle 31 counterclockwise so as to be opened, thereby removing the jammed transfer paper. In this case, the operator needs only to grip and raise the handle 31 for transportation to thereby open with ease the upper body 3 in which the motor 30, optical system of lens train 10, photosensitive drum 9, developing unit 16 and cleaning unit 25 are disposed. Also, the operation of handle 31 can weaken or eliminate a conventional strong spring provided for pushing up the upper body 3 to be opened.

Also, as far as the original receiving plate 6 is not locked by the original receiving plate locking mechanism 64, the upper and lower bodies 3 and 4 are not opened each other, whereby there is no fear that the original receiving plate 6 moves while the upper body 3 is released.

Next, explanation will be given on a case where the body 1 is transported.

Firstly, as shown in FIG. 3, the original receiving plate locking mechanism 64, as mentioned above, locks the original receiving plate 6, the body 1 is turned counterclockwise in FIG. 3 with the handle 31 gripped by the operator, and he only needs to transport the body 1 by his hand gripping the handle 31 kept above. In this case, the body 1 is transported with safe because the original receiving plate locking mechanism 64 holds the original receiving plate 6 not to move. Also, the paper feed cassette 34 and paper discharge tray 56 are disposed at the handle side, whereby there is no fear that these accessories escape from the body 1 during the transportation.

As seen from the above, the image forming apparatus of the invention, which provides the handle at only one side surface of the body 1, is easy to be transported. In the aforesaid first embodiment, the handle 31 and the upper and lower body locking mechanism 59 on the side surface opposite to the hinge 2 are disposed at the same side surface, so that the handle, after both the upper and lower bodies 3 and 4 are unlocked, is utilizable as a handle and a guide when both the upper and lower bodies 3 and 4 are opened, thereby facilitating the opening work and having superiority in design. Also, since the paper feed cassette 34 is provided only at the handle side, the body 1 can be transported with safe without fear of falling off the cassette 34.

Next, explanation will be given on a second embodiment of the invention.

Figure 6:
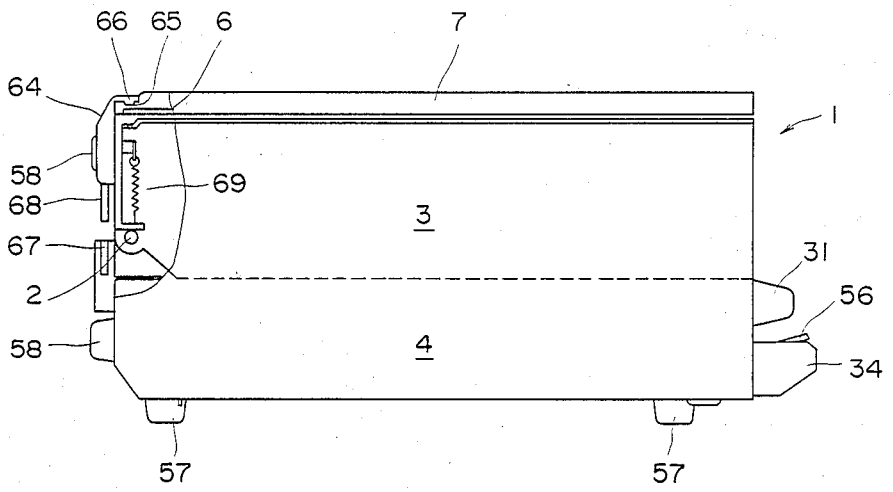
FIG. 6 is a typical side view of a second embodiment of the copying machine as an image forming apparatus of the present invention.

FIG. 6 is a schematic diagram of the second embodiment of the invention, in which a handle 31 is provided at the side wall of the lower body 4 opposite to the hinge 2, and other components are quite the same as in the first embodiment.

In the second embodiment, even when the handle 31 is held up to lift the body 1 for its transportation, the locking mechanism 59 is not subjected to load, whereby the locking mechanism 59 is free from distortion or trouble. Hence, there is no fear that mismatching in position or torsion occurs between both the upper and lower bodies 3 and 4 when the copying is carried out by locking both the bodies 3 and 4 with the locking mechanism 59, thereby ensuring the stable copying quality.

Next, explanation will be given on a third embodiment of the invention.

The third embodiment of the image forming apparatus of the invention is provided with a handle 31 at either the upper or the lower body which is larger in weight. In other word, the copying machine dividable of the body 1 into two of the upper and lower bodies 3 and 4 as shown in FIGS. 1 through 7 is provided at the upper body 3 with the main components, such as the motor 30, original receiving plate 6, and photosensitive drum 9, relatively larger in weight, whereby the upper body 3 is fairly larger in weight than the lower body 4. Hence, such usual copying machine is provided at the upper body 3 with the handle 31 as in the first embodiment. For the copying machine with the lower body 4 heavier than the upper body 3, or an image forming apparatus other than the copying machine, for example, a facsimile equipment or a printer, in which the lower body 4 is heavier than the upper body 3, the handle 31 is provided at the lower body 4 as shown in the second embodiment.

Accordingly, the third embodiment of such construction, when the handle 31 is held up for the transportation, is not applied an excessive load to the locking mechanism 59 and also can provide the handle 31 at the position just above the center of gravity of the body 1 in condition of falling the body 1 sideways at an angle of 90°, thereby increasing the stability during the transportation.

Next, explanation will be given on a forth embodiment of the invention.

Figure 7:
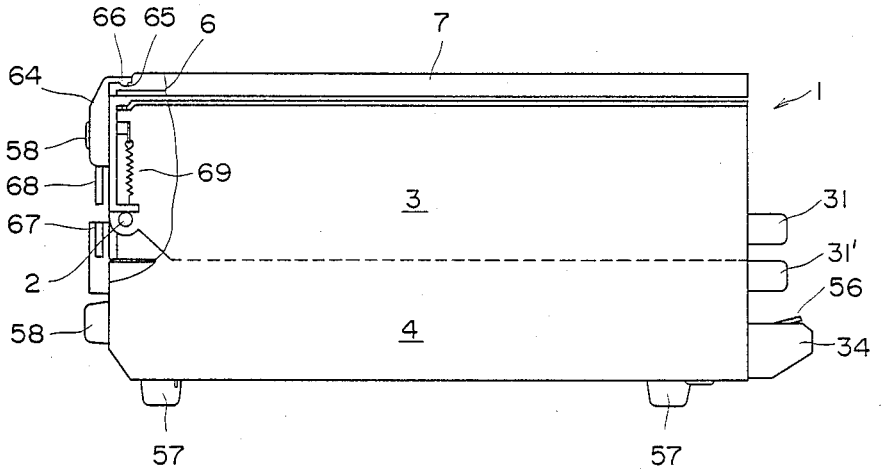
FIG. 7 is a typical side view of a fourth embodiment of the copying machine as an image forming apparatus of the present invention.

Referring to FIG. 7 of the schematic side view thereof, handles 31 and 31' are provided at the side surfaces (where the locking mechanism 59 is provided in the same way as the former embodiment) of the upper and lower bodies 3 and 4 opposite to the hinge 2 respectively.

In the fourth embodiment of such construction has the advantage of both the first and second embodiments (of course, that of the third embodiment, too). Furthermore, when both the handle 31 and 31' are held together during the transportation, even if the locking mechanism 59 is released, the danger of separately releasing of the bodies 3 and 4 is avoided.

Next, explanation will be given on a fifth embodiment of the invention.

Figure 8:
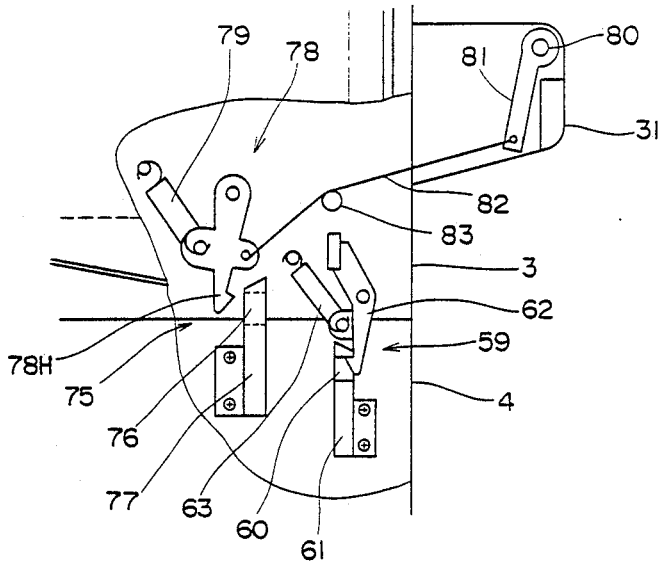
FIGS. 8, 9 and 10 are typical side views of a fifth embodiment of the same.

The apparatus of the fifth embodiment is provided with a first example of an auxiliary locking mechanism 75 for more reliably preventing the upper and lower bodies 3 and 4 from being open during the transportation. FIG. 8 is a typical side view of a first example of the auxiliary locking mechanism 75 provided at the body 1. Other components, such as the upper and lower bodies 3 and 4 and locking mechanism 59 are the same in construction as the former embodiments.

The auxiliary locking mechanism 75 shown in FIG. 8 is mounted mainly on the lower body 4 and comprises a fixture 77 provided at its projection toward the upper body 3 with an engaging bore 76 and a hook member 78 pivoted at the upper end thereof to the upper body 3, the hook member 78 having at the lower end thereof a hook 78H engageable with engaging bore 76 so that the hook 78H is biased by a spring 79 hooked at the hinge 2 side leftwardly in FIG. 8, concretely, toward the hinge 2. A wire 82 connects at one end with a portion of the hook member 78 at the handle 31 side and at the other end with a free end of a movable member 81 pivoted to the inside of the handle 31 through a pivot 80. In addition, reference numeral 83 designates a guide for regulating the wire 82 in position. In the fifth embodiment of the aforesaid construction of the invention in a case where the handle 31 is held, the movable member 81 is also held and its free end moves away from the body 1 (counterclockwise in FIG. 8). Hence, the wire 82 is pulled and the hook member 78 turns counterclockwise in FIG. 8, whereby the hook 78H engages with the engaging bore 76 at the fixture 77. Accordingly, as far as the handle 31 is held during the transportation, the hook 78H of the hook member 78 at the upper body 3 side engages with the engaging bore 76 of the fixture 77 at the lower body 4, whereby even if the locking mechanism 59 is disconnected, it never happens that the upper and lower bodies 3 and 4 are released. Thus, the present embodiment further ensures the safety during the transportion of the body 1.

Figure 9:
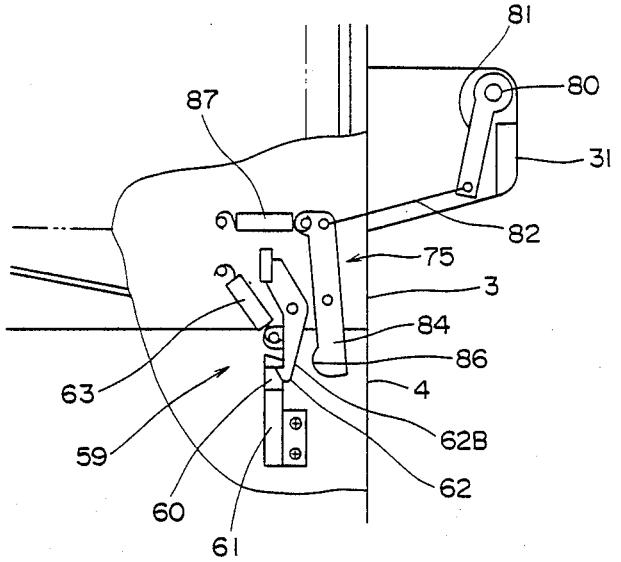

FIG. 9 is a partially sectional view of the body 1 of a second example of the auxiliary locking mechanism 75, in which a biasing member 84 for a hook member 62 for forcibly impeding disconnection of the locking mechanism 59 is provided. The biasing member 84 is pivoted at an intermediate portion thereof to the upper body 3 and has at the lower end a projection 86 adapted to bias the back face 62B (opposite to the biasing direction of the hook member 62) of the hook member 62 at the locking mechanism. Furthermore, at the upper end of the biasing member 84 is attached a spring 87 for biasing the biasing member 84 to be turned counterclockwise (in the direction of moving the projection 86 at the biasing member away from the hook member 62) in FIG. 9. Also, a movable member 81 for the handle 31 and a wire 82 connected thereto are provided in the same way as the first example of the auxiliary locking mechanism 75 in FIG. 8.

In the second example of the auxiliary locking mechanism 75 in the fifth embodiment of the invention of the above construction, while the handle 31 is held, the wire 82 is pulled to turn the biasing member 84 clockwise in FIG. 9. Hence, the projection 86 at the biasing member 84 biases the back face 62B of hook member 62 at the locking mechanism 59, whereby there is no fear of disengaging of the hook member 62 from the engaging bore 60 at the fixture 61.

Accordingly, the upper and lower bodies 3 and 4, in the same way as the first example, is prevented from being separated.

Figure 10:
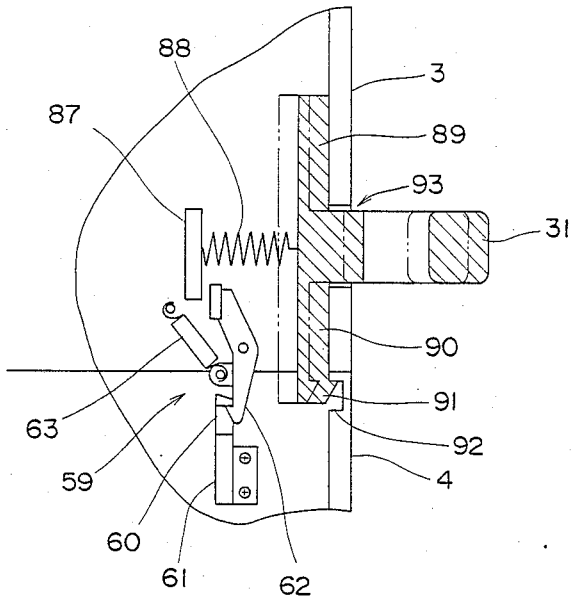

FIG. 10 is typical partially sectional view of a third example of the auxiliary locking mechanism for the body 1.

In FIG. 10, the handle 31 is not fixed to the body 1, but projects outwardly from the body 1 through a slot 93 formed at the upper body 3. Plate-like holders 89 and 90 for holding the body 1 during the transportation are formed at the portion of handle 31 within the body 1, the upper holder 89 coming into close contact with the inner surface of the side wall of the upper body 3 during transportation to thereby hold the upper body 3, the lower holder 90 holds, during the transportation the inner surface of the side wall lower than the handle 31 and the inner surface of the upper side wall of the lower body 4 and having a hook 91 projecting from the lower end of the holder 90, meanwhile, at the upper end of the inner surface of the side wall of lower body 4 is provided with an engaging groove 92 at the place engageable with hook 91.

A spring 88 is interposed between side surface of holders 80 and 90 of the handle 31 in the body 1 and a support member 87 fixed to the upper body 3, so that in the state where the body 1 takes the posture of copying operation, the handle 31 is positioned as shown by the two-dot chain line in FIG. 10, concretely projects outwardly from the body 1 in an extent of being kept not-engaged with the engaging groove 92 at the inner surface of the side wall of lower body 4.

In the above-mentioned construction, during the normal copying operation, the hook 91 at the lower holder 90 does not engage with the groove 92 inside the lower body 4, whereby the locking mechanism 59 is released and the handle 31 is lifted to open the upper body 3. Also, during the transportation, as far as the handle 31 is held up, the upper and lower holders 89 and 90 come into close contact with the inner surface of side wall of the body 1, due to the weight of the body 1, whereby the hook 91 at the holder 90 engages with the groove 92. Accordingly, even if the locking mechanism 59 is disconnected during the transportation, there is no fear that the upper and lower bodies 3 and 4 are separated from each other.

Next, explanation be given on a sixth embodiment of the image forming apparatus of the invention.

Figure 11:
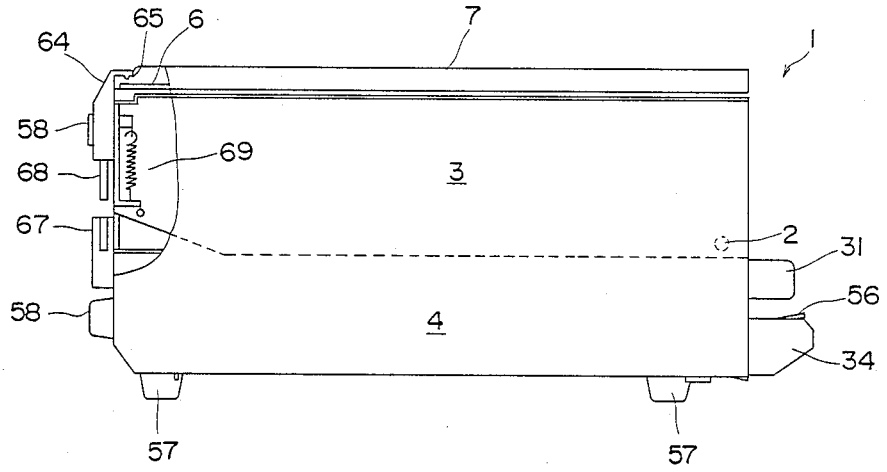
FIG. 11 is a typical side view of a sixth embodiment of the same.
Figure 12:
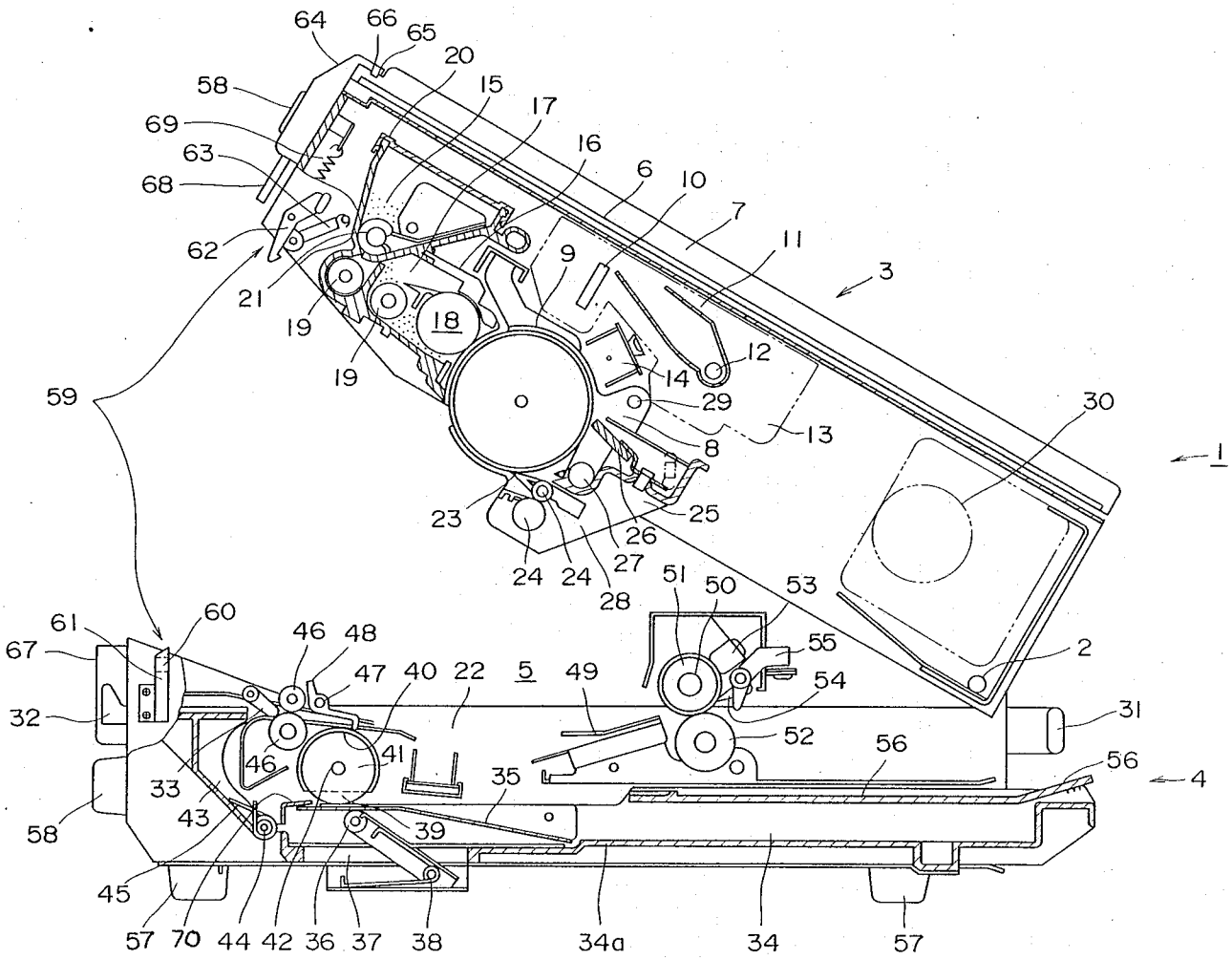
FIG. 12 is a sectional side view of the sixth embodiment of the invention, showing the upper body in condition of being upwardly open.

FIG. 11 is a exterior side view of the sixth embodiment of the image forming apparatus or copying machine and FIG. 12 is a sectional side view thereof, in which upper and lower bodies 3 and 4 are separately open.

The sixth embodiment is different from the former embodiments in that a hinge 2 for coupling the upper and lower bodies 3 and 4 and a handle 31 are provided at the same surface of the body 1.

Concretely, an original receiving plate locking mechanism 64 and a manual paper feeding plate 32 are provided at the same side surface similarly to the former embodiments, but a locking mechanism 59, differently from the former embodiments, is provided on the side surface on which the original receiving plate locking mechanism 64 and manual paper feeding plate 32 are provided. The handle 31 and hinge 2 are provided at the side surface opposite to the side surface of supporting the original receiving plate locking mechanism 59, concretely at the side surface (the right-hand side in FIGS. 11 and 12) on which an inlet of the paper feeding cassette 34 is provided. In addition, other components in the sixth embodiment are the same as those in the former embodiments.

The sixth embodiment of the aforesaid construction, even when the locking mechanism 59 is disconnected during the transportation, provide the handle 31 and hinge 2 at the same surface, so the there is no fear of separately opening the upper and lower bodies 3 and 4. Since the locking mechanism 59 is not subjected to an overload, the locking mechanism 59 needs only be relatively simple in construction and is less in a fear of causing distortion. Furthermore, the locking mechanism is free from an external force intended to release it during the transportation. Hence, the sixth embodiment of the image forming apparatus of the invention is extremely high in the safety during the transportation.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A portable type image forming apparatus comprising a main body with an upper body and a lower body, said upper and lower bodies being coupled by hinge means mounted at one side face of said main body, a locking mechanism for locking said upper body and lower body is provided at one side face of said upper body and lower body opposite to said hinge means, at one side face of said main body at least one handle is located for transporting of said apparatus, said handle positioned at the side face of said body opposite to the side face receiving said hinge means, and an auxiliary locking mechanism which operates by holding said handle to lock said upper body and lower body is provided at said side face of the upper and lower body opposite to said hinge means.

2. A portable type image forming apparatus as set forth in claim 1, wherein said handle is provided at said upper body.

3. A portable type image forming apparatus as set forth in claim 1, wherein said handle is provided at said lower body.

4. A portable type image forming apparatus as set forth in claim 1, wherein said handle is provided at said upper body when said upper body is heavier than said lower body.

5. A portable type image forming apparatus as set forth in claim 1, wherein one said handle is provided at each said upper body and lower body.

6. A portable type image forming apparatus as set forth in claim 1, wherein said auxiliary locking mechanism directly and mechanically locks said upper body and lower body.

7. A portable type image forming apparatus as set forth in claim 1, wherein said auxiliary locking mechanism prevents said locking mechanism from releasing operation.

8. A portable type image forming apparatus as set forth in claim 1, wherein said handle is provided at said lower body when said lower body is heavier than said upper body.

9. A portable type image forming apparatus as set forth in claim 1, wherein accessories for image forming are provided only at the side face on which said handle is provided.

10. A portable type image forming apparatus as set forth in claim 1, wherein a cushion member is provided at the side face of said body opposite to the said face on which said handle is provided.

11. A portable type image forming apparatus as set forth in claim 1, wherein said handle enables the apparatus to keep upwardly said side surface of the main body receiving said handle.

* * * * *